United States Patent [19]

Axford et al.

[11] Patent Number: 4,958,165

[45] Date of Patent: Sep. 18, 1990

[54] CIRCULAR POLARIZATION ANTENNA

[75] Inventors: Walter J. Axford, Chalfont St. Peter; Satwinder S. Chana, Hayes, both of England

[73] Assignee: Thorm EMI plc, London, England

[21] Appl. No.: 204,562

[22] Filed: Jun. 9, 1988

[30] Foreign Application Priority Data

| | | | |
|---|---|---|---|
| Jun. 9, 1987 | [GB] | United Kingdom | 8713489 |
| Jun. 23, 1987 | [GB] | United Kingdom | 8714717 |
| Oct. 28, 1987 | [GB] | United Kingdom | 8725249 |
| Nov. 6, 1987 | [GB] | United Kingdom | 8726082 |
| Dec. 7, 1987 | [GB] | United Kingdom | 8728534 |

[51] Int. Cl.[5] ..... H01Q 13/00

[52] U.S. Cl. ..... 343/770; 343/771

[58] Field of Search ..... 343/767, 768, 770, 771

[56] References Cited

U.S. PATENT DOCUMENTS

| | | | |
|---|---|---|---|
| 4,131,894 | 12/1978 | Schiavone | 343/700 MS |
| 4,242,685 | 12/1980 | Sanford | 343/770 |
| 4,443,802 | 4/1984 | Mayes | 343/770 |
| 4,614,947 | 9/1986 | Rammos | 343/778 |
| 4,626,865 | 12/1986 | Rammos | 343/786 |

FOREIGN PATENT DOCUMENTS

| | | | |
|---|---|---|---|
| 52-550 | 4/1977 | Japan | 343/770 |
| 128903 | 10/1980 | Japan | 343/770 |
| 502567 | 8/1977 | U.S.S.R. | 343/771 |
| 2074792 | 11/1981 | United Kingdom | 343/767 |

*Primary Examiner*—Michael C. Wimer

*Attorney, Agent, or Firm*—Fleit, Jacobson, Cohn, Price, Holman & Stern

[57] ABSTRACT

An element which acts as an antenna and circular-polarizer for the domestic reception of DBS signals has a front plate of aluminum alloy, with two slots and of differing length and orthogonally crossing at their mid-points. The width and length of slots and are chosen in order to provide equal power flow through the slots and adequate bandwidth appropriate to the format of the DBS frequency band.

Behind the plate the element has a rectangular housing to form a cavity containing a suspended strip line with a support whose free end is located below the point of crossing the two slots, and which extends outwardly therefrom in a straight line bisecting the angle formed by adjacent arms of the slots and being in a plane parallel to the plate.

2 Claims, 9 Drawing Sheets

60
61
62
66
67
68
X
X'
λg/4
λg
λg/2

60
61
62
63
64
65
66
68
X
X'

CIRCULAR POLARIZATION ANTENNA

The present invention relates to a cross-slot antenna.

U.S. Pat. No. 4242685 describes an antenna for providing circular polarization having symmetrical crossed slots energized by a radiating conductive plate which is elliptical, the cavity having two feed points.

Summary of the Invention

The present invention provides an antenna comprising an antenna element with a boundary surface having a pair of orthogonal, crossed slots of differing dimensions to provide transfer of circularly-polarised signals through the slots, the antenna element having an associated feed for signals.

Such an antenna may provide conversion between linearly polarised signals and circularly polarised signals.

Preferably, the boundary surface defines part of a cavity associated with the signal feed.

The length of one of the slots in a pair may be greater than the other and/or the width of one may be greater than the other.

Preferably, the dimensions of the two slots are such that the power transfer through each slot is substantially equal. Moreover, preferably the width of the slots are such that an appropriate value of bandwidth is achieved.

The cavity can be any appropriate shape in cross-section, for example square, rectangular or circular. The cavity may be filled with a dielectric material, thereby enabling the antenna to be made more compact as compared to an air-filled cavity of equivalent signal reception/transmission characteristics. Additionally or alternatively, the cavity may be ridged to enhance compactness.

The antenna may incorporate a number of cavities each with an associated pair of slots and a respective feed. Alternatively, the antenna may incorporate a waveguide as a cavity, the waveguide having a number of pairs of slots, acting as a common feed for the slots.

Preferably, the antenna element comprises an electrically conductive front plate having the pair of slots and, arranged in parallel lines on either side thereof, a first array of spacer elements on one side of the plate, said spacer elements comprising distortions of the profile of the plate to give corresponding indentations on the other side of the plate, an electrically conductive back plate having a second array of spacer elements on one side of the plate, arranged to match the first array, to enable corresponding spacer elements in said front and back plates to make contact simultaneously, a feed conductor arrangement supported on a dielectric substrate placed between said front and back plates to allow pairs of corresponding spacer elements on each of said plates to support said substrate, the feed conductor being arranged between the parallel lines of spacer elements.

In one advantageous form, there is provided many spacers such as to form barriers to the generation of unwanted parallel plate modes. If a good match is obtained between the feed line and the element then there is little energy available to unwanted modes.

In a preferred embodiment, the conductive plates are sufficiently thin that dimples and/or linear grooves can be punched in them to form spacer elements on the other side of the plates of equal height to provide a uniform spacing between each plate and the dielectric substrate.

In another preferred embodiment the channels formed by the spacer elements are filled with a foam material having low dielectric loss and a relative permittivity exceeding unity. The dielectric foam has the effect of increasing the wavelength in the transmission line ($\lambda g$) compared with the wavelength in air ($\lambda a$). If the slots are spaced $\lambda g$ apart, they will be less than $\lambda a$ apart, with the advantage that the effect of grating lobes will be reduced while retaining the convenience of straight feed conductors.

In another embodiment, the array of slot pairs comprises a two-dimensional arrangement of rows and columns with spacer elements on either side of rows (or columns) of slot pairs, consisting of either protrusions spaced more closely than the slot pairs or linear ridges, thereby forming a channel for each row (or column) of slot pairs to ensure that unwanted parallel plate modes are suppressed.

This invention provides a flat, inexpensive, convenient aerial which is simple and inexpensive to manufacture. The conducting plates can be made simply and cheaply by punching the slots and dimples in, for example, 1 mm thick aluminium alloy plates. The dielectric substrate can be copper-clad polyester or polyimide film and the conductor pattern can be produced by photo-etching. The foam (if used) can be polyethylene or polyurethane. The polymer film and the polymer foam are both lightweight and inexpensive and combine to form a transmission line with very low dielectric losses, in contrast to the higherpermittivity metallised substrate normally used for printed antenna arrays. Furthermore, the slot pattern can be designed to have a response beam inclined at an angle up to about 30 degrees from the normal to the plane of the slots.

The antenna may incorporate a number of antenna elements each with an associated pair of slots and a respective feed.

In a preferred embodiment, the antenna further comprises means to reduce the presence, in the element, of signals additional to those transferred through the slots.

Preferably, the reduction means operates to minimise the generation of unwanted transmission modes, especially those produced due to the presence of the slots causing a discontinuity on the feed line. Thus for example advantageously, the reduction means comprises an aperture located in a position which is generally symmetrically opposite the slot pair relative to the associated feed; preferably the aperture is generally circular.

Advantageously, the antenna includes means to effect reflection of signals, the reflection means being located behind an aperture of the reduction means relative to the feed. Thus, for example when the antenna is used in a transmission mode, some of the signal from the feed can pass through an aperture and is then reflected back through it and on through the slot pair for transmission out of the antenna. The reflection means may comprise a reflective plate which is common to a number of apertures, or it may comprise a number of reflective cylinders, each dedicated to a particular separate aperture.

The reduction means may also comprise a plurality of dimples arranged in the vicinity of a slot pair, the separation of the dimples being such that, for the values of radiation appropriate to the operation of the antenna, they effect a conductive wall or surface. Advantageously the dimples in the vicinity of a slot pair are arranged to substantially surround the slot pair.

Such an antenna may provide efficient conversion between linearly polarised signals and circularly polarised signals.

Another aspect of the present invention provides an aerial arrangement comprising an electrically conductive front plate having at least one linear array of slots responsive to microwave radiation and having, arranged in parallel lines on either side thereof, a first array of spacer elements on one side of the plate, said spacer elements comprising distortions of the profile of the plate to give corresponding indentations on the other side of the plate, an electrically conductive back plate having a second array of spacer elements on one side of the plate, arranged to match the first array, to enable corresponding spacer elements in said front and back plates to make contact, a feed conductor arrangement and a dielectric substrate placed between said front and back plates to allow pairs of corresponding spacer elements on each of said plate to support said substrate, the feed conductor arrangement being located between the parallel lines of spacer elements so as to provide a series feed to at least one row of slots.

Preferably, the substrate has a number, less than the total number of dimple pairs, of apertures to allow electrical contact and securement between facing spacer elements. Advantageously, the substrate comprises a sheet of dielectric film having a number of holes formed therein at suitable locations to correspond with facing spacer elements, constituted for example by dimples on the plates. The facing spacer elements may be spot-welded together. Alternatively, the facing elements may be rivetted together, whether or not the substrate has holes formed therein prior to the rivetting operation.

According to this aspect, the present invention may also provide an aerial arrangement comprising an electrically conductive front plate having at least one linear array of slots responsive to microwave radiation and having, arranged in parallel lines on either side thereof, a first array of spacer elements on one side of the plate, said spacer elements comprising distortions of the profile of the plate to give corresponding indentations on the other side of the plate, an electrically conductive back plate having a second array of spacer elements on one side of the plate, arranged to match the first array, to enable corresponding spacer elements in said front and back plates to make contact simultaneously, a feed conductor arrangement supported on a dielectric substrate placed between said front and back plates to allow pairs of corresponding spacer elements on each of said plate to make contact with either side of said substrate at the same region of the substrate, the feed conductors being arranged between the parallel lines of spacer elements so as to provide a series feed to respective rows of slots.

An antenna embodying the present invention is particularly applicable to use as a dish antenna feed or in an array antenna, or in any arrangement requiring an antenna/polariser for receiving circularly-polarised signals, especially in the microwave or millimetre wave ranges. Advantages of the invention include : simplicity in construction and therefore low cost; low weight; planar format; operability with circularly-polarised signals; a design requiring few layers of materials.

The feed for the antenna may be of any appropriate form, for example, a suspended strip line or a feed line supported on a suitable substrate.

BRIEF DESCRIPTION OF THE DRAWINGS

In order that the invention may more readily be understood, a description is now given, by way of example only, reference being made to the accompanying drawings, in which.

DESCRIPTION OF THE PREFERRED EMBODIMENTS

Figure 1:
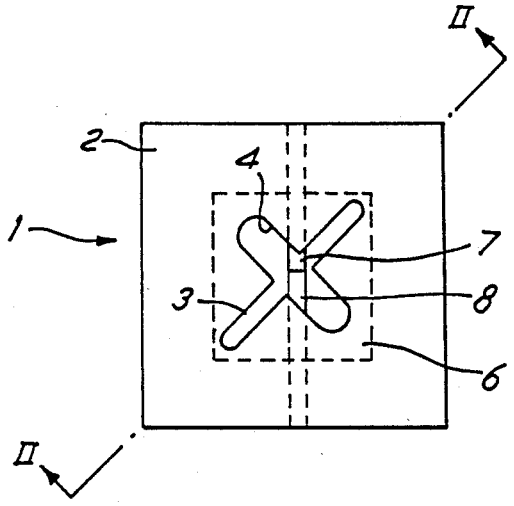
FIG. 1 is a plan view of an antenna embodying the present invention.
Figure 2:
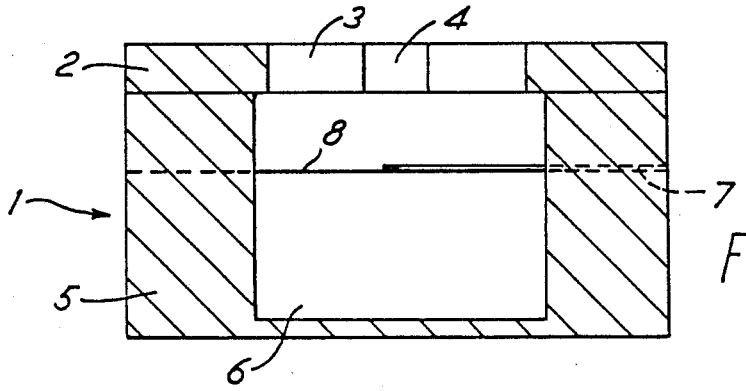
FIG. 2 is a cross-sectional view in the direction of arrows II—II as shown in FIG. 1.

There is shown in FIGS. 1 and 2 an element 1 which acts as an antenna and circular-polarizer for the domestic reception of Direct Broadcast by Satellite (DBS) signals. Element 1 has a front plate 2 of 1.2 mm thick aluminium alloy, with two slots 3 and 4 of differing length and orthogonally crossing at their midpoints. Slot 3 has an overall length of 1.5 mm and width of 15 mm, while slot 4 has an overall length of 11.8 mm and width of 2.5 mm, these values being chosen in order to provide equal power flow through the slots and adequate bandwidth (for example 6 to 7%) appropriate to the format of the DBS frequency band.

Behind plate 2, element 1 has a rectangular housing 5 to form a cavity 6. Housing 5 contains a suspended strip line 7 with a support 8, whose free end is located below the point of crossing of the two slots, and which extends outwardly therefrom in a straight line bisecting the angle formed by adjacent arms of slots 3 and 4 and being in a plane parallel to the plate 2.

In order to obtain signals with the other hand of circular polarization, the plate 2 requires an arrangement of slots such that slot 4 replaces slot 3, and vice versa. This can readily be achieved by inverting plate 2 in relation to housing 5.

Antenna 1 can readily achieve cross-polarisolation better than 18 dB over a 500 MHz bandwidth (12.0–12.5 GHz).

Figure 3:
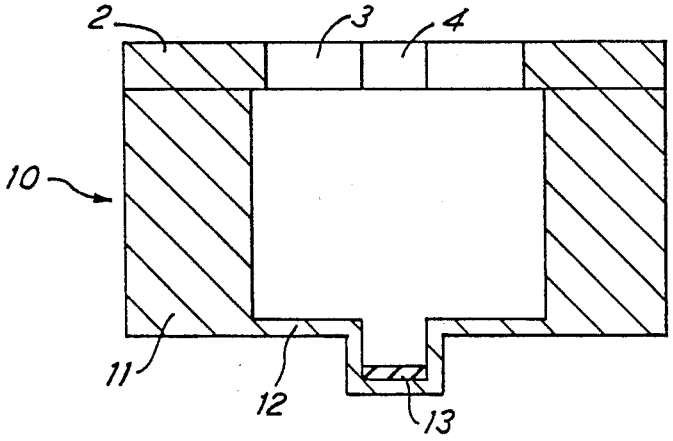
FIG. 3 is a cross-sectional view of a different embodiment of the present invention to that shown in FIG. 2.

FIG. 3 shows another form of antenna element 10 embodying the present invention in an equivalent cross-sectional view to that of FIG. 2, and incorporating an identical front plate 2 with slots 3 and 4. Element 10 has a housing 11 whose cross-section is essentially rectangular except for a recess which forms a trough 12 extending the width of the cavity formed by housing 11. Trough 12 incorporates the feed 13 for element 10.

Figure 4:
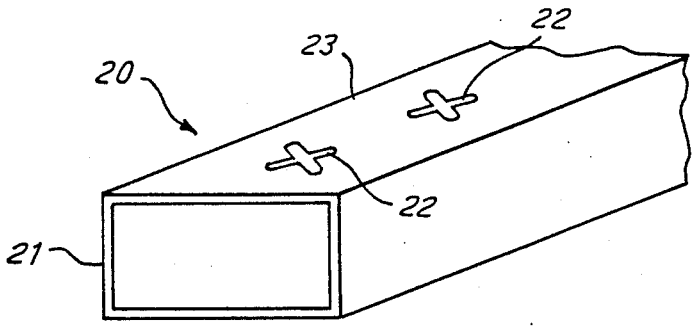
FIG. 4 is a perspective view of another antenna embodying the present invention.

FIG. 4 shows another form of antenna 20, embodying the present invention; antenna 20 is a length of waveguide 21 with a rectangular cross-section, the waveguide 21 having a number of pairs of slots 22 spaced along the length of one panel 23 of the waveguide. Each pair of slots 22 is essentially the same as that described with reference to FIG. 1, and is oriented on panel 23 such that a line, which bisects the angle between adjacent arms of the slots, runs parallel to the longitudinal axis of waveguide 21.

Figure 5:
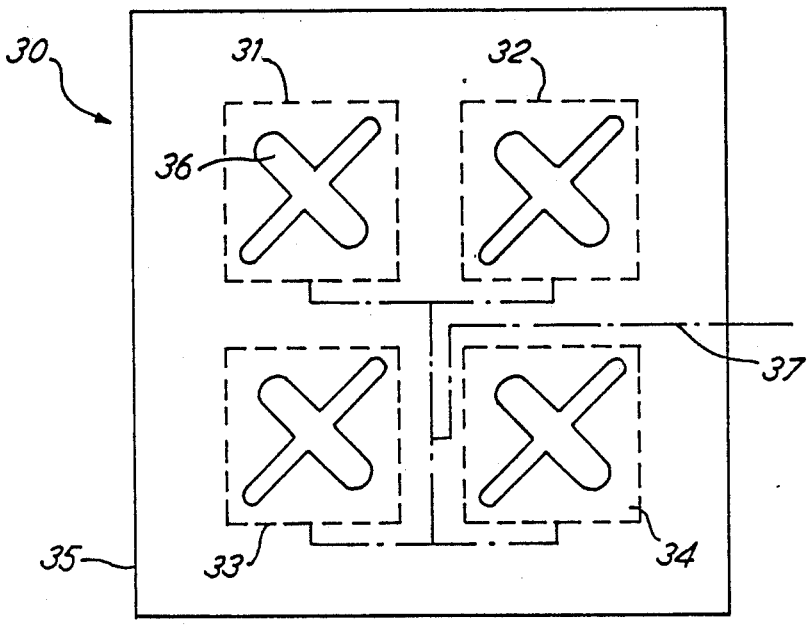
FIG. 5 is a plan view of a further antenna embodying the present invention.

FIG. 5 shows, in plan view, an antenna array 30 formed of antennas 31, 32, 33, 34 embodying the present invention. Array 30 has a square front plate 35 of 1.2 mm thick aluminium alloy, with four pairs of slots 36, arranged with their centres 21 mm apart, each pair being identical and consisting of one slot dimensioned 13.0 by 1.5 mm orthogonally crossed with another slot dimensioned 12.4 by 2.5 mm. Under front plate 35, array 30 has a body (not referenced) of aluminium alloy which is substantially solid except for four recesses to form the cavities of antennas 31 to 34. The body also has embedded conductive tracking 37 to act as feeds for the antennas 31 to 34 and array 30.

Any of the above-described forms of antenna can be modified by providing the cavity or cavities with a cross-section, in plan view, incorporating one or more ridges. Thus for example, the cavity 6 for antenna 1 may be of the shape corresponding to the capital letter H when viewed as shown in FIG. 1. In this way, the cross-sectional area can be reduced without substantially affecting the antenna performance to allow more space for feed lines and/or to render it more compact.

In another modification, the cavity or cavities of an antenna contains dielectric material in order to enable the size of the cavity to be reduced as compared to an air-filled cavity of the same signal reception/transmission characteristics.

Figure 6:
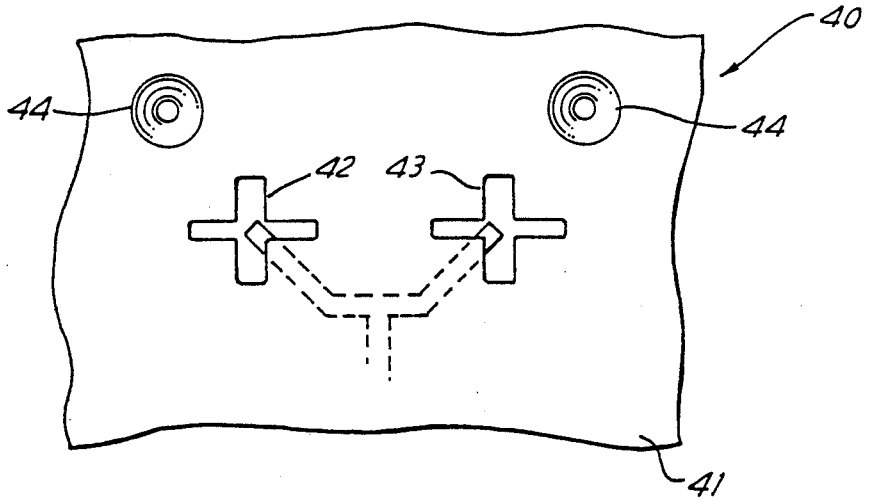
FIG. 6 is a plan view of another antenna embodying the present invention.
Figure 7:
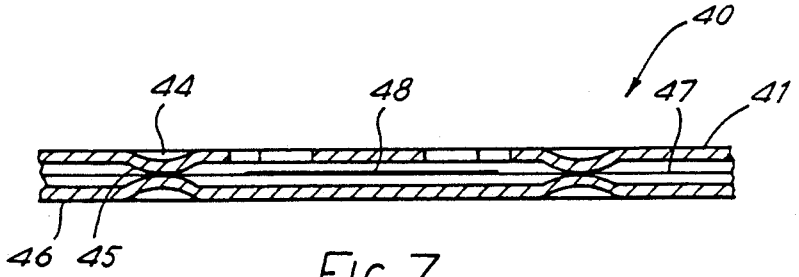
FIG. 7 is a cross-sectional view of the antenna of FIG. 6.

FIGS. 6 and 7 show part of another form of antenna and circular-polarizer for the domestic reception of Direct Broadcast by Satellite (DBS) signals and is formed from a two-dimensional network of elements 40. Element 40 has a front conductive plate 41 with two slot pairs 42 and 43, the slots of each pair being of differing length and orthogonally crossing at their midpoints. One slot of a pair has an overall length of 1.5 mm and width of 15 mm, while the other slot of a pair has an overall length of 11.8 mm and width of 2.5 mm, these values being chosen in order to provide equal power flow through the slots and adequate bandwidth (for example 6 to 7%) appropriate to the format of the DBS frequency band.

The front conductive plate 41 has dimples 44 formed on the external surface, which provide corresponding spacer elements 45. The dimples 44 are formed on either side of the array of slot pairs, and may also be formed between the slots (not shown). The back conductive plate 46 does not have slots but has an arrangement of dimples and spacer elements matching those of the upper plate 41. Between the two plates is a dielectric film 47 carrying the feed conductor 48. This conductor provides a series feed to the slot pairs, the input/output connection being offset from the centre of the array by a quarter of the wavelength in the transmission line. The front and back plates 41, 46 respectively may conveniently be constructed of 1 mm thick aluminium alloy sheet and the dimples or linear indentations punched to a constant depth, for example 1.6 mm. The slots in the front conductive plate 41 could be punched at the same time. The slot pairs are spaced one wavelength apart, as required for a broadside response beam the relevant wavelength being that in the transmission line ($\lambda g$). The channel formed by the dimples or linear indentations 44 is filled with dielectric foam. An antenna of square shape of about 0.45 m length of side is suitable for the reception of DBS signals.

In order to obtain signals with the other hand of circular polarization, the plate 41 requires an arrangement of slots such that, in each pair, the slots are changed round. This can readily be achieved by inverting plate 41 in relation to plate 46.

Antenna 40 can readily achieve cross-polarisolation better than 18 dB over a 500 MHz bandwidth (12.0 - 12.5 GHz).

Preferably, the dielectric film 47 has suitably located holes which provide electrical contact between facing dimples and position the film; thus the dimples can be secured together by spot-welding. In another arrangement, whether or not the film has such holes, the facing dimples may be rivetted together to effect electrical contact and securing.

In any of the embodiments described hereinbefore, it is advantageous to fill each channel formed by the dielectric film, one of the metallic plates and two rows of dimples on either side of the row of slot pairs with polymer dielectric foam. This reduces the velocity factor in the feed conductors, enabling straight feed conductors to be used when the slot pairs are spaced apart by less than a wavelength in air to reduce the effect of grating lobes. Metallised rigid foam may be used to form the conductor array on one surface, and hence dispense with the dielectric film.

In any of the embodiments described hereinbefore, the feed conductors and the orthogonal conductor can be terminated at the periphery of the array by wedge-shaped resistive film, card or silicone rubber to absorb unradiated microwave power. Alternatively the feed conductors may be left open-ended to form a resonant feed network. The feed conductor pattern may also be formed on both sides of the dielectric film.

In any of the two-dimensional embodiments described hereinbefore, the orthogonal feed conductor may be split into two parallel conductors symmetrically positioned on either side of the centre line of the array. The orthogonal feed conductor provides an end feed to one half of each of the feed conductors and the other orthogonal feed conductor provides an end feed to the other half of each of the feed conductors. The input/output is offset from the centre line of the array by a quarter of the wavelength in the transmission line. This arrangement has the advantage of avoiding the use of any three-way power dividers.

In any of the embodiments described hereinbefore the rows of dimples may be replaced by continuous indentations, the individual protrusions forming the spacer element becoming continuous ridges. This may facilitate the manufacture of the top plate.

The above embodiments show that the invention provides a convenient, compact, flat microwave aerial, which is inexpensive to manufacture, and unobtrusive, has very low dielectric losses and is suitable for domestic use for receiving DBS signals.

The use of dimpled plates for clamping the feed network carrier and spacing the plates from each other with a crossed slot circularly polarised radiating element can suffer from the disadvantage that the radiating element introduces a discontinuity on the feed line. This situation can result in the generation of a number of unwanted parallel plate modes which dissipate energy that is required to be coupled to the crossed slots radiating element. This problem can be overcome to a large extent by positioning a number of dimples around the radiating element thereby putting the element in a type of conducting cavity. The physical dimensions of such an arrangement may be, however, too large to permit an array to be constructed in which the spacings between elements is an optimum for efficient operation.

Figure 8:
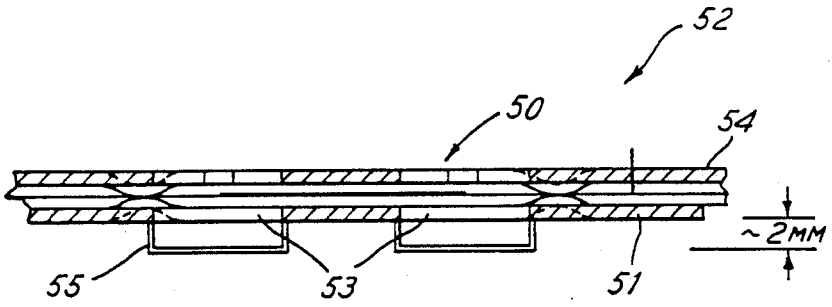
FIG. 8 is a cross-sectional view of another antenna embodying the present invention.

FIG. 8 shows an arrangement to reduce the generation of unwanted parallel plate transmission modes at the radiating element constituted by the slot pair 50, wherein, plate 51 of antenna 52 has an aperture 53 to balance that of the slots in plate 54. A simple circular aperture has been found adequate to reduce the unwanted modes. In order to prevent at least half the available energy escaping through the circular aperture 53 in plate 54 and reducing the efficiency of the antenna, the circular aperture 53 leads into a shorted length of cylindrical waveguide 55, the electrical length of which is about one quarter of a wavelength. Thus the signal which couples to the circular aperture 53 in plate 51 is reflected at the shorted end of the cylinder and arrives back at the junction of the feedline and the radiating element and is radiated in phase with signals radiated directly.

Figure 9:
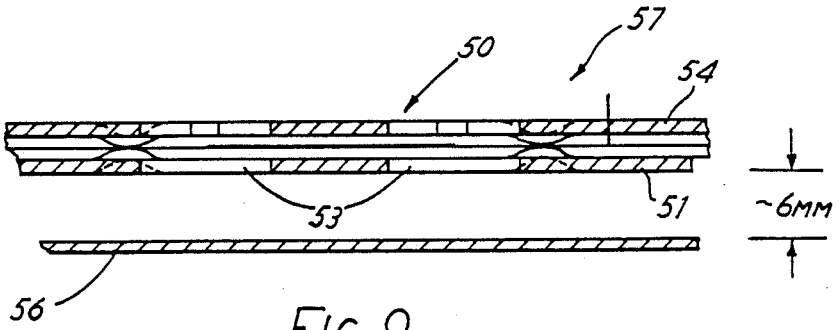
FIG. 9 is a cross-sectional view of a further antenna embodying the present invention.

FIG. 9 shows an alternative in which the wall of the cylinder is removed and the base replaced by an extended conducting sheet, plate 56, the efficiency of the radiating structure being substantially unaffected. Thus, antenna 57 consists of three conducting layers, 51, 54 and 56. When operating frequencies in the region of 12 GHz the distance between plates 51 and 54 is about 2.0 mm. The dimples in each plate are therefore about 1.0 mm deep. The dimples clamp in place the thin dielectric layer which supports the printed feed network. Plate 56 is separated by about 6 mm from plate 51. This spacing can be reduced and the overall thickness of the antenna reduced if walled cavities are used, in which case the distance between 51 and the base of the cylinder is about 2 mm.

An array of these elements together with a suitable feed network would provide a lost cost, light antenna suitable for receiving satellite TV broadcasts.

Figure 10:
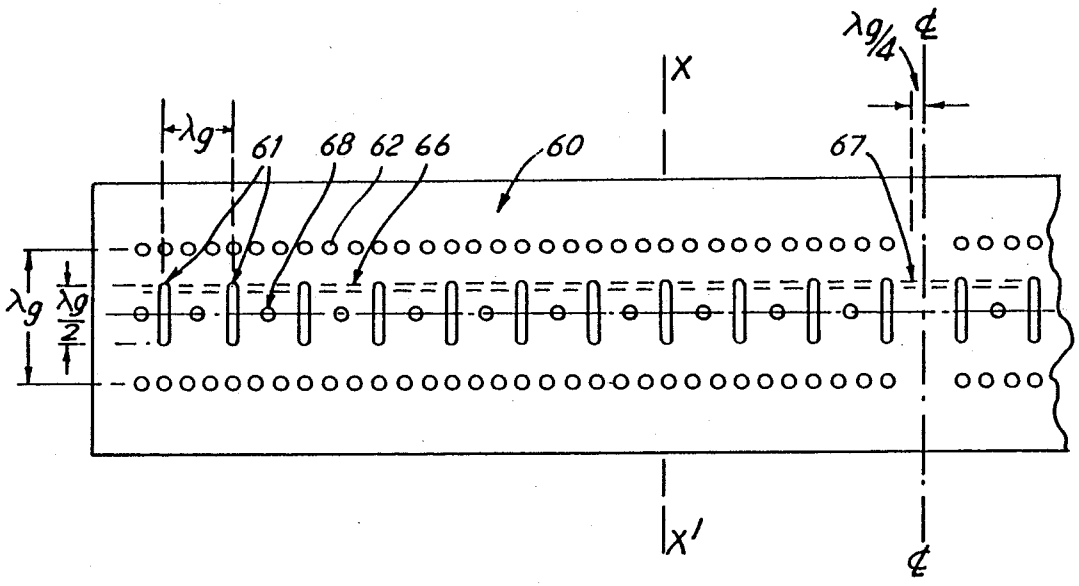
FIG. 10 shows a linear array in an aerial.
Figure 11:
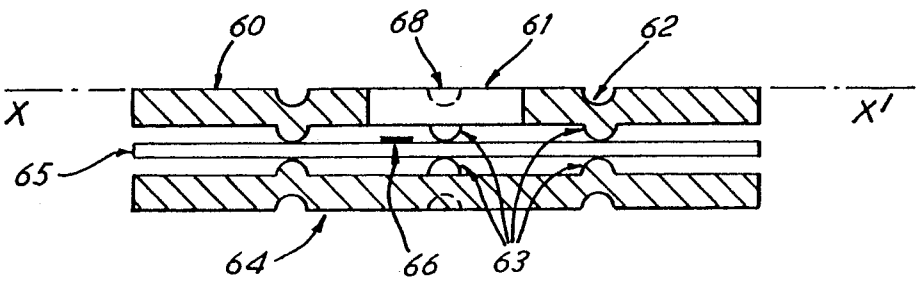
FIG. 11 shows a cross-section at X-X' of the linear array of FIG. 10.

In the example of a linear array shown in FIG. 10, a front conductive plate 60 has a linear array of slots 61, which may be oriented in accordance with the required polarisation response. The slots 61 can be arranged parallel to each other (as shown) for linear polarisation or adjacent slots can be arranged orthogonal to each other for circular polarisation as described hereinafter with reference to FIG. 14. FIG. 11 shows a cross-section of the antenna at X-X'. The front conductive plate 60 has dimples 62 formed on the external surface, which provide corresponding spacer elements 63, shown in FIG. 11. The dimples 62 are formed on either side of the array of slots 61 and those shown at 68 are formed between the slots. The back conductive plate 64 does not have slots but has an arrangement of dimples and spacer elements matching those of the upper plate 60. Between the two plates is a dielectric film 65 carrying the feed conductor 66. This conductor provides a series feed to the slots 61, the input/output connection 67 being offset from the centre of the array by a quarter of the wavelength in the transmission line. The front and back plates 60, 63 respectively may conveniently be constructed of 1 mm thick aluminium alloy sheet and the dimples or linear indentations punched to a constant depth, for example 1.6 mm. The slots in the front conductive plate 60 could be punched at the same time. The slots are half a wavelength long and are shown as spaced one wavelength apart, as required for a broadside response beam the relevant wavelength being that in the transmission line ($\lambda g$). The channel formed by the dimples or linear indentations 62 is filled with dielectric foam.

Figure 12:
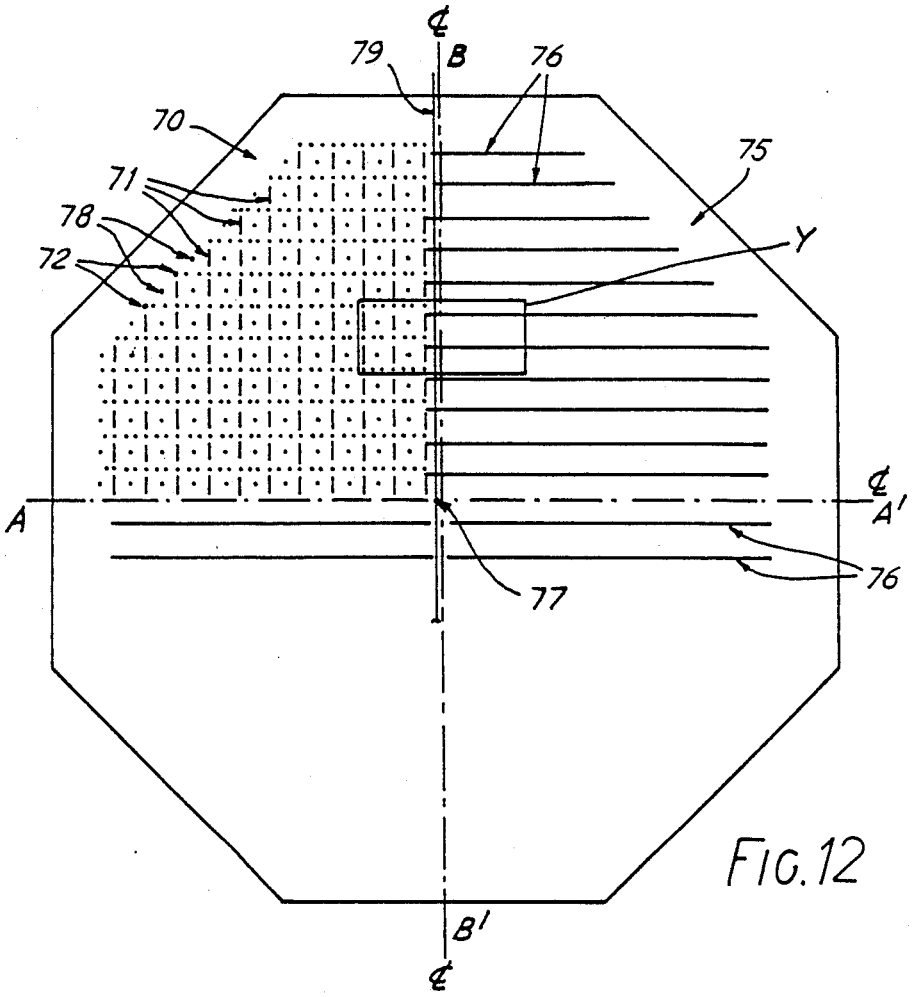
FIG. 12 shows a two-dimensional array.

A two-dimensional arrangement is shown in FIG. 12, comprising an octagonal front conductive plate 70 having rows of slots 71, with dimples 72 between each row of slots and dimples 78 between the slots within each row of slots. The dimples produce corresponding spacer elements, as at 63 in FIG. 11. The back conductive plate (not shown in FIG. 12) is also octagonal and has an array of dimples and corresponding spacer elements matching those of the front conducting plate 70, similar to FIG. 11. A dielectric film lies between the two arrays of spacer elements, as shown at 65 in FIG. 11, and carries the feed conductor array. In FIG. 12, the slots and dimples in the front conductive plate are similar in all quadrants of the aerial, adjacent quadrants being mirror images of each other, such that the aerial has two symmetrical axes, AA' and BB'. The slots and dimples are shown only in the top left quadrant so that the conductor array on the dielectric film 75 can be shown in the other quadrants. The conductor array comprises respective row feed conductors 76 for each row of slots, the arrangement being similar to that of the feed conductor 66 in FIG. 10. An orthogonal feed conductor 79 intersects each of the row feed conductors 76 at a point offset from the centre of the corresponding row of slots by a quarter of the wavelength in the transmission line. The input/output 77 is situated on the orthogonal feed conductor 79 offset from the centre of the feed conductors 76 by a quarter of the wavelength in the transmission line. The channels formed by the rows of dimples or linear indentations 72 are filled with dielectric foam.

Figure 13:
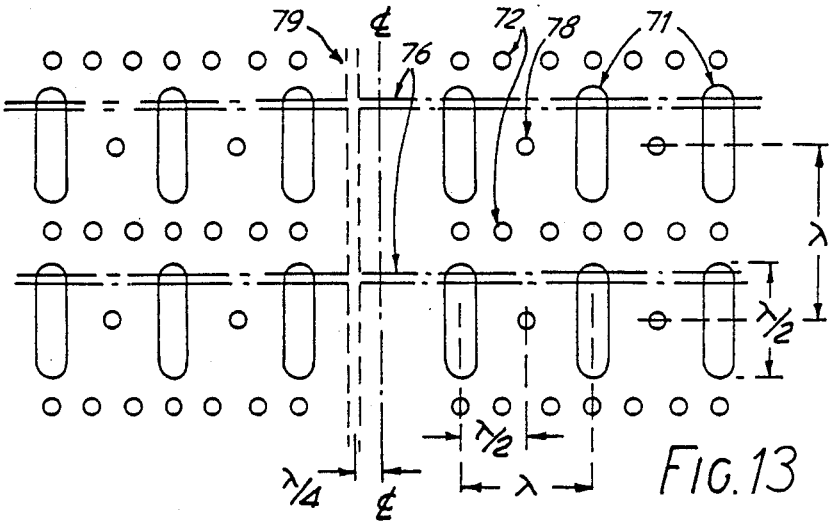
FIG. 13 shows an enlarged view of part of the array shown in FIG. 12.

FIG. 13 shows an enlarged view of a small part $\lambda$ of the array of FIG. 12 comprising two row feed conductors 76, each feeding three slots 71 on either side of the orthogonal feed conductor 79. Various spacings for a broadside response beam are indicated in terms of the wavelength in the transmission line.

Figure 14:
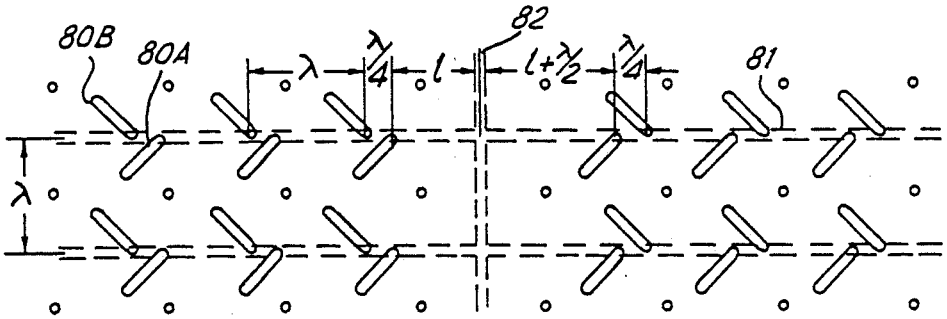
FIGS. 14 to 17 show parts of various arrays of slots arranged to operate with circular polarisation.

FIG. 14 shows a small part of a two-dimensional arrangement for use with circular polarisation, comprising rows of pairs of slots. The slots 80A and 80B within each pair are orthogonal and the intersections with the feed conductor 81 are spaced apart by a quarter of the wavelength in the transmission line in order to be responsive to circular polarisation. As in the arrangement shown in FIG. 13, the feed conductors 81 are connected to an orthogonal feed conductor 82, which is offset from the centres of the rows of slots by a quarter of the wavelength in the transmission line. FIG. 14 shows an arrangement responsive to left-hand polarisation, as determined by the inclination of the slots nearest to the orthogonal feed conductor 82. The spacings shown in FIG. 14 are for a broadside response beam.

Figure 15:
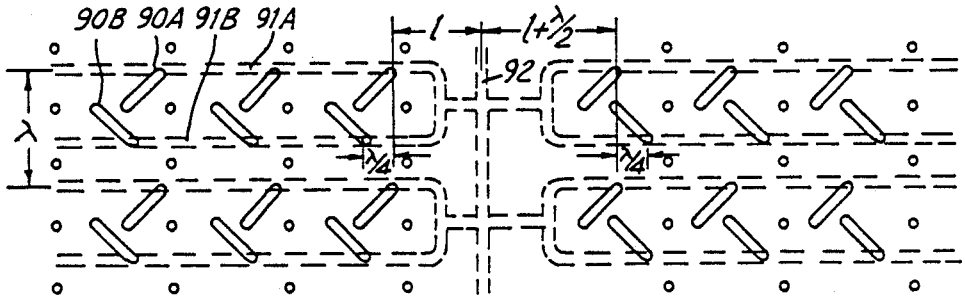
Figure 16:
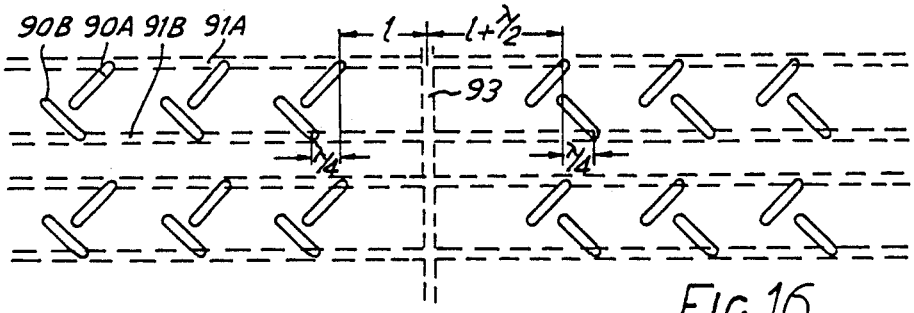

FIGS. 15 and 16 show small parts of two-dimensional arrangements for use with circular polarisation in which each row of orthogonal pairs of slots 90A, 90B is fed by a pair of feed conductors 91A, 91B.

The set of parallel slots 90A is fed by the feed conductor 91A and the orthogonal set of parallel slots 90B by the feed conductor 91B. Similar to the arrangement shown in FIG. 14, the intersections of the slots 90A and 90B within each pair with the respective feed conductors 91A, 91B are spaced apart in the row direction by a quarter of the wavelength in the transmission line to be responsive to circular polarisation. The feed conductors 91A, 91B of each pair of feed conductors can either be joined together before being connected to the orthogonal feed conductor 93, as in FIG. 15, or they can be separately connected to the feed conductor 93, as in FIG. 16. The spacings shown in FIGS. 6 and 7 are for a broadside response beam.

The basic construction of the arrangements for use with circular polarisation is similar to that described hereinbefore with reference to FIGS. 12 and 13. Only the patterns of slots and conductors are altered.

In any of the embodiments described hereinbefore, it is advantageous to fill each channel formed by the dielectric film, one of the metallic plates and two rows of dimples on either side of the row of slots with polymer dielectric foam. This reduces the velocity factor in the feed conductors, enabling straight feed conductors to be used when the slots are spaced apart by less than a wavelength in air to reduce the effect of grating lobes. If metallised rigid foam became available, it would be advantageous to form the conductor array on one surface and dispense with the dielectric film.

In any of the embodiments described hereinbefore, the feed conductors and the orthogonal conductor can be terminated at the periphery of the array by wedge-shaped resistive film, card or silicone rubber to absorb unradiated microwave power. Alternatively the feed conductors may be left open-ended to form a resonant feed network. The feed conductor pattern may also be formed on both sides of the dielectric film.

Figure 17:
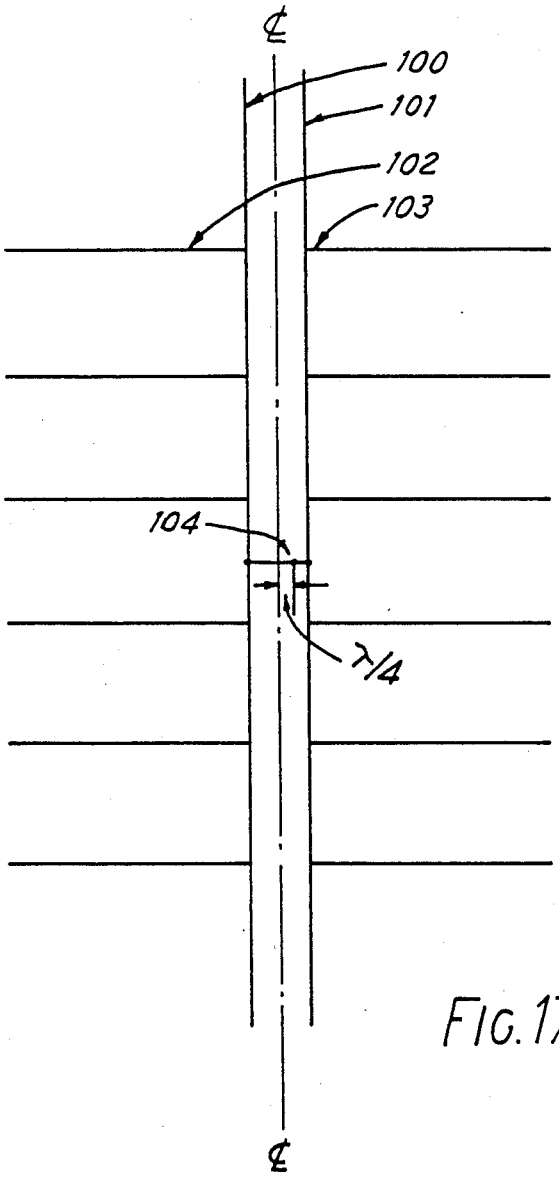

In any of the two-dimensional embodiments described hereinbefore with reference to FIGS. 12 to 16, the orthogonal feed conductor may be split into two parallel conductors 100 and 101 symmetrically positioned on either side of the centre line of the array, as shown in FIG. 17. The orthogonal feed conductor 100 provides an end feed to one half 102 of each of the feed conductors and the other orthogonal feed conductor provides an end feed to the other half 103 of each of the feed conductors. The input/output 104 is offset from the centre line of the array by a quarter of the wavelength in the transmission line. This arrangement has the advantage of avoiding the use of any three-way power dividers.

In any of the embodiments described hereinbefore the rows of dimples may be replaced by continuous indentations, the individual protrusions forming the spacer element becoming continuous ridges. This may facilitate the manufacture of the top plate.

The above embodiments show that the invention provides a convenient, compact, flat microwave aerial, which is inexpensive to manufacture, and unobtrusive, has very low dielectric losses and is suitable for domestic use for receiving DBS signals.

Figure 18:
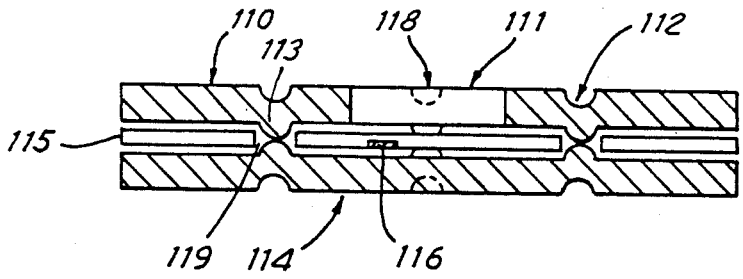
FIG. 18 is a cross-sectional view of an elongate antenna strip.

As shown in FIG. 18, a front conductive plate 110 has a linear array of slots 111 and dimples 112 formed on its external surface on each side of the array of slots 111 to provide spacer elements 113; dimples 118 are formed between the slots in the direction of length of the antenna. A back conductive plate 114 has an arrangement of dimples and spacer elements to match those of upper plate 110, but no slots. Between the two plates is a dielectric film 115 carrying the feed conductor 116.

In this modification, film 115 has a pre-formed aperture 119 to correspond with the position of each facing pair of dimples and spacer elements, thereby to allow electric contact between plates 110 and 114 and to position the film. The facing dimples are butt-welded together.

In a variant, facing dimples are rivetted together to effect electrical and mechanical connection therebetween. Preferably the film 115 again has pre-formed apertures to accommodate the rivets; alternatively, the film is suitably holed during, or just prior to, the rivetting operation.

The dielectric sheet can be polyester, polyimide film or glass epoxy, as in the layers of a multilayer pcb. In a 512 element array using a suspended strip line feed network, no significant difference in antenna performance was detected when using epoxy glass as compared with Kapton. The glass epoxy sheet is stiffer than the other types of film and therefore is more easily retained as a planar film during assembly. The Kapton film can sag under its own weight and tends to 'drape' itself over the dimples. It is possible that the conducting plates of the antenna structure are not produced flat over their whole area; for example, in a small (120 mm×90 mm) plate which had been 'dimpled', the plates tend to curl up slightly at the ends. To be sure of good clamping of the dielectric sheet, adhesive can be applied to the dielectric sheet in areas corresponding to the dimples so that when the structure is assembled there is a positive force holding the structure together over the whole area of the antenna. Other mechanical clamping techniques would still be required around the periphery. This could be by nut-and-bolt, welding, riveting or a frame into which the layered structure fits. The latter technique has further potential for easing the job of providing a hermetic seal.

Clearly the present invention is applicable to an antenna with linear polarization characteristics, and to use with circular polarization characteristics.

We claim:

1. An antenna comprising an antenna element having; an electrically conductive front plate having at least one slot, which slot comprises at least one pair or orthogonal slots of differing dimensions to provide transfer of circularly-polarised signals through the said slots; a first array of spacer elements on one side of the front plate, said spacer elements comprising indentations of the surface profile of the one side of the front plate such that corresponding protrusions are formed around and aligned with said indentations on the other side of the front plate; an electrically conductive back plate having a second array of spacer elements on one side of the back plate, arranged to correspondingly align with and face towards said first array, a feed conductor arrangement supported on a dielectric substrate placed between said front plate and said back plate to allow pairs of corresponding spacer elements on each of said plates to support said substrate, the feed conductor arranged to be situated intermediate successive spacer elements.

2. An antenna comprising an antenna element having; an electrically conductive front plate having at least one slot, which slot comprises at least one pair of orthogonal slots, which pair of slots are crossed, and of differing dimensions to provide transfer of circularly-polarised signals through said slots; a first array of spacer elements on one side of the front plate, said spacer elements comprising indentations of the surface profile of the one side of the front plate such that corresponding protrusions are formed around and aligned with said indentations on the other side of the front plate; an electrically conductive back plate having a second array of spacer elements on one side of the back plate, arranged to correspondingly align with and face towards said first array; a feed conductor arrangement supported on a dielectric substrate placed between said front plate and said back plate to allow pairs of corresponding spacer elements on each of said plates to support said substrate, the feed conductor arranged to be situated intermediate successive spacer elements.

* * * * *

UNITED STATES PATENT AND TRADEMARK OFFICE
Certificate

Patent No. 4,958,165 Patented: Sept. 18, 1990

On petition requesting issuance of a certificate for correction of inventorship pursuant to 35 U.S.C. 256, it has been found that the above-identified patent, through error and without any deceptive intent, improperly sets forth the inventorship. Accordingly, it is hereby certified that the correct inventorship of this patent is:
Walter J. Axford, Satwinder S. Chana, James Tomlinson and Francis Robert Tumble.

Signed and Sealed this Twenty-fifth Day of December, 1990.

ROLF HILLE

*Supervisory Patent Examiner*
*Group Art Unit 258*